US005604951A

United States Patent [19]

Shipp

[11] Patent Number: 5,604,951

[45] Date of Patent: Feb. 25, 1997

[54] PROPHY TOOTHBRUSH

[76] Inventor: Anthony D. Shipp, 351 N. Foothill Rd., Beverly Hills, Calif. 90210

[21] Appl. No.: 366,789

[22] Filed: Dec. 30, 1994

[51] Int. Cl.[6] ..... A46B 9/04

[52] U.S. Cl. ..... 15/167.1; 15/110; 15/188; 15/DIG. 5; 401/268; 601/141

[58] Field of Search ..... 15/110, 167.1, 15/167.2, 186–188, DIG. 5; 401/268; 433/1; 601/139, 141

[56] References Cited

U.S. PATENT DOCUMENTS

| | | | |
|---|---|---|---|
| D. 49,472 | 8/1916 | Dierke . | |
| D. 139,264 | 10/1944 | Littig . | |
| 1,188,823 | 6/1916 | Plank | 15/110 |
| 1,268,544 | 6/1918 | Cates | 15/110 |
| 1,598,224 | 8/1926 | Van Sant | 15/167.1 |
| 1,965,009 | 7/1934 | Stevens | 15/188 |
| 2,059,914 | 11/1936 | Rosenberg | 15/110 |
| 2,312,828 | 3/1943 | Adamsson | 15/167.1 |
| 2,545,814 | 3/1951 | Kempster | 15/188 |
| 3,007,441 | 11/1961 | Eyer | 433/1 |
| 3,754,295 | 8/1973 | Hyman | 15/167.1 |
| 4,053,959 | 10/1977 | Wiley | 15/167.1 |
| 4,150,457 | 4/1979 | Larson | 15/106 |
| 4,185,349 | 1/1980 | Papas | 15/106 |
| 4,524,478 | 6/1985 | Ross | 15/106 |
| 4,738,001 | 4/1988 | Shipp | 15/106 |
| 4,929,180 | 5/1990 | Moreschini | 433/166 |
| 5,348,473 | 9/1994 | Kivlighan, Jr. | 433/114 |

FOREIGN PATENT DOCUMENTS

| | | | |
|---|---|---|---|
| 642228 | 8/1928 | France | 15/167.1 |

OTHER PUBLICATIONS

Harvey, Dr. Colin E., "Most common small animal disease countered with preventive dentistry", *DVM,* Apr., 1986.

DVM, "Your Animal Friend", *DVM,* Summer 1986.

Gherna, Carla and Rydalch, Ina, "There's more to life than people". *Cerritos College Dental Hygiene.*

"Dog–O–Dontics", *Canine Dental Health.*

Wilson, Jo Engle; Kravitz, Sandy McCandliss; Powers, Barbara, "Is Dental Hygiene Just for People?", *SCDHA Journal,* Summer 1984.

Pet Nutrition and Care Research Staff, "Dental Care: an important safeguard for a dog's health",*Purina Kennel News,* vol. 85, Issue 3.

Hartman, Deb, "Periodontitis In Canines", *American VVeterinary Dental Society, AVDS News Letter,* Spring 1985, vol. 2, No. 1.

Ryan, C. P., "Dental Problems In Animals", *Today's Animal Health,* pp. 12–15.

"Canine Dentistry —Symposium Proceedings", *Annual Eastern States Veterinary Conference,* Jan. 1984.

Frost, Patricia, "Canine Dentistry; Dental Calculus".

*Primary Examiner*—Mark Spisich
*Attorney, Agent, or Firm*—Lyon & Lyon

[57] ABSTRACT

A toothbrush for cleaning and polishing teeth includes a handle attached to a brush head. Attached to the brush head is at least one prophy cup device for polishing teeth, and a plurality of bristle tufts for scrubbing teeth, the bristle tufts being attached to the brush head and placed about the perimeter of each prophy cup device.

2 Claims, 2 Drawing Sheets

PROPHY TOOTHBRUSH

BACKGROUND OF THE INVENTION

1. Field of the Invention

This invention relates generally to toothbrushes used for the cleaning of teeth and gums.

2. Background Information

Cleaning of teeth is very important because unclean teeth are primarily responsible for the most common disease encountered in human and animal medicine—gingivitis and periodontal disease (or periodontitis). Periodontal disease is a term used to describe diseases of the tooth attachment apparatus, the gums, tooth roots, bone surrounding the teeth, and the periodontal ligament tissue joining tooth to bone. Symptoms range from gum inflammation (gingivitis), formation of plaque (food and bacteria), and bad breath (halitosis), to serious accumulation of tartar (mineralized plaque), bleeding, receded or eroded gums, loose or infected teeth, and eventual loss of teeth. Periodontal disease is also the major cause of bad breath in human beings, dogs, and cats. If untreated, periodontal disease often leads to severe damage of major organ systems, and can shorten the life of the afflicted human being or animal. Thus, teeth cleaning is essential to good health.

When teeth are cleaned by a dentist or dental hygienist, generally instruments such as scalers and curettes are used initially to clean the crown and subgingival (under the gums) portions of the tooth. After this cleaning has been performed, a prophylaxis polishing cup, or "prophy cup", mounted on a low-speed dental handpiece is employed. The prophy cup is typically made of a soft rubber-like material and contains at least one central cavity portion that is loaded with pumice paste or another similar abrasive. The prophy cup is then held against the surface of a tooth while being mechanically rotated, e.g., by means of the dental handpiece. This procedure forces the pumice paste to abrade across the surface of the tooth, thereby polishing the tooth, leaving as smooth a surface as possible. A smooth tooth surface helps reduce future plaque and calculus (tartar) build up. Plaque builds up within hours of tooth brushing and the smoother the surface of the tooth, the longer it takes for plaque to adhere to the tooth.

Normal dental hygiene is then continued outside of the dental office and includes regular brushing of the teeth with a toothbrush. This brushing typically occurs one to three times a day. Before brushing, toothpaste is placed on top of the bristles on the toothbrush. During brushing, the bristles of the toothbrush act to scrub the teeth. The use of toothbrushes for dental hygiene has been described in U.S. Pat. No. 4,738,001, which is incorporated herein by reference.

The above described conventional dental hygiene program suffers from a number of major disadvantages. During the brushing process, the toothbrush bristles generally do not follow the contours of teeth as closely as the soft, rubber-like prophy cup. Therefore, the teeth are not left with a surface that is as smooth as desired and the detrimental early onset of periodontal disease is encouraged.

Further, during the toothbrushing process, upon contact of the toothpaste covered bristles with teeth, the toothpaste is spread into the mouth and between the toothbrush bristles, and does not concentrate its effect directly on the teeth in contact with the bristles. Therefore, the toothpaste does not act as effectively as it could.

Also, often times conventional toothbrushes are designed with relatively thick bristles-which can cause problems with sensitive gums and teeth. Since gingivitis and periodontal disease often starts in the area below the gum line, the cleaning of this area is extremely important.

Therefore, a need was perceived for a toothbrush that would clean teeth and gums, and in the process leave the teeth with a smoother surface than conventional toothbrushes, make more effective use of toothpaste, and improve the cleaning of the area below the gum line.

SUMMARY OF THE INVENTION

The present invention is directed to a toothbrush that satisfies the foregoing need for improved dental cleaning. A toothbrush having features of the present invention comprises a platform upon which to mount a prophy cup device and bristle tufts. In the preferred embodiment, the platform comprises a handle having a longitudinal axis, and a brush head, the brush head being attached to the handle. At least one prophy cup device made of a flexible, rubber-like material is attached to brush head. The sides of the prophy cup device extend from the brush head. The prophy cup device has at least one central cavity portion allowing for placement of tooth cleaning material, such as toothpaste, in at least one central cavity. The soft rubber-like prophy cup device follows the contours of teeth more effectively than bristles, and provides for polishing of the teeth. Each central cavity portion of the prophy cup device holds more toothpaste for a longer period of time than a conventional toothbrush, providing for more effective use of the toothpaste. In the preferred embodiment, the prophy cup device contains vanes extending from the sides of the prophy cup device into each central cavity and the prophy cup device generally has a shape similar to the brush head.

Also secured to the brush head is a plurality of bristle tufts. Each bristle tuft comprises a plurality of individual bristles. The bristle tufts are spaced apart and are placed about the perimeter of the prophy cup device. The bristle tufts also extend from the brush head to above the prophy cup device. This arrangement of bristle tufts and the prophy cup device provides for both bristles that scrub the surface of and in between teeth, as well as a soft rubber-like element that polishes and smoothes the surface of the teeth. In the preferred embodiment, the individual bristles are made of a synthetic material, preferably nylon, and are approximately 0.005 to 0.006 inches in diameter to ensure softness when in contact with the gums, and to clean the area under the gums. These bristles are soft and are less likely to cause pain to sensitive gums than thicker bristles.

In another inventive aspect of the preferred embodiment, some of the bristle tufts are arranged such that a single row of lateral bristle tufts is placed about, and substantially symmetrical to, each side of the prophy cup device, along lines substantially parallel to the longitudinal axis of the handle. Additionally, a cluster of trailing bristle tufts is placed on the end of the brush head most proximal to the handle, and a cluster of leading bristle tufts is placed on the end of the brush head most distal from the handle, both of these clusters extending towards the prophy cup device. The leading and trailing bristle tufts are longer than the lateral bristle tufts. This positioning and extra length of the leading and trailing bristle tufts allows these tufts to advance and follow between the teeth. The leading bristle tufts, being longer, will also aid in more effective cleaning of the most candal (posterior) teeth, which can be difficult to reach with a toothbrush.

Accordingly, it is an object of the present invention to provide an improved toothbrush for scrubbing and polishing of teeth and the cleaning of gums. Other and further objects and advantages will appear hereinafter.

BRIEF DESCRIPTION OF THE DRAWINGS

It is to be understood that the accompanying drawings are provided for the purpose of illustration only, and are not intended as a definition of the limits of the invention. The drawings schematically illustrate a preferred embodiment of the present invention in which.

DETAILED DESCRIPTION OF THE PREFERRED EMBODIMENT

Figure 1:
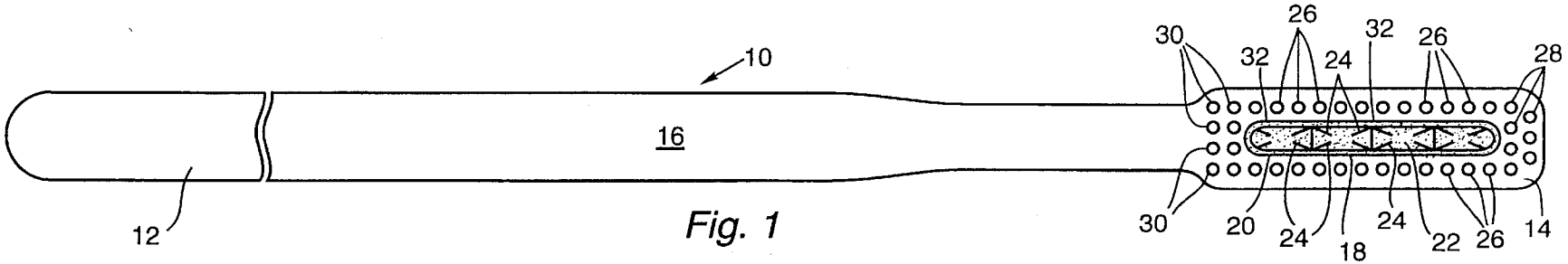
FIG. 1 is a top plan view of a prophy toothbrush in accordance with the preferred embodiment.

Referring to the drawings, FIG. 1 shows a toothbrush 10, comprised of a handle 12, and a brush head 14 connected to the handle. The handle 12 is relatively long and narrow, allowing it to be easily manipulated. The handle has a longitudinal axis 16. In the preferred embodiment, the brush head 14 is of a generally rectangular shape. It would be apparent to one skilled in the art however, that the brush head 14 could be formed in other shapes, such as trapezoids, ovals, and circles.

Secured to the brush head 14 is a prophy cup device 18. The prophy cup device 18 is made of a soft, flexible rubber, or rubber-like material. In the preferred embodiment the prophy cup device 18 is generally of a similar shape to the brush head 14, that shape being generally rectangular. The prophy cup device 18 has sides 20 extending from the brush head 14. The prophy cup device 18 also has at least one central cavity portion 22 into which toothpaste or other tooth cleaning material may be placed.

In the preferred embodiment, the prophy cup device 18 also contains a plurality of vanes 24 extending from the sides 20 of the prophy cup device 18 into at least one central cavity portion 22. These vanes 24 serve to retain tooth cleaning material and increase the cleaning surface area of the prophy cup device 18. These vanes 24 also add structural stability to the prophy cup device 18. The use of vanes, or "ribs" as they are sometimes characterized, in prophy cups has been described in U.S. Pat. Nos. 4,929,180 and 5,348,473, which are incorporated herein by reference.

Figure 4:
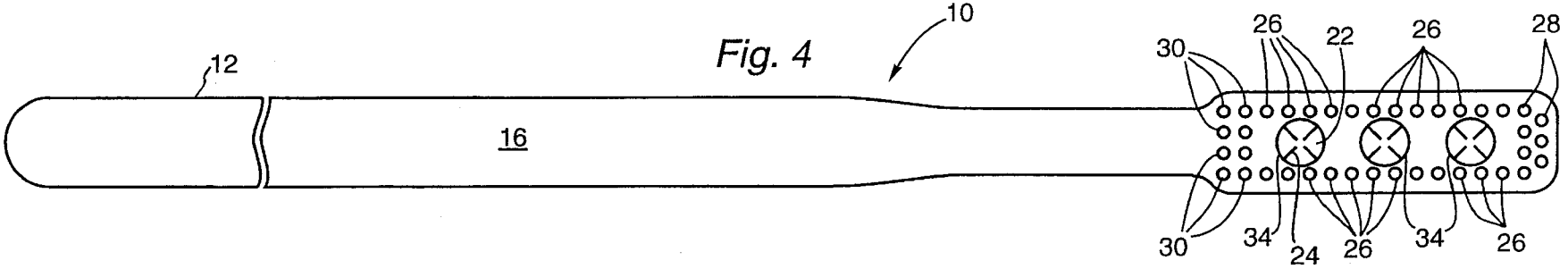
FIG. 4 is a top plan view of a prophy toothbrush, illustrating an embodiment of the prophy toothbrush employing substantially cylindrical shaped prophy cup devices.
Figure 5A:
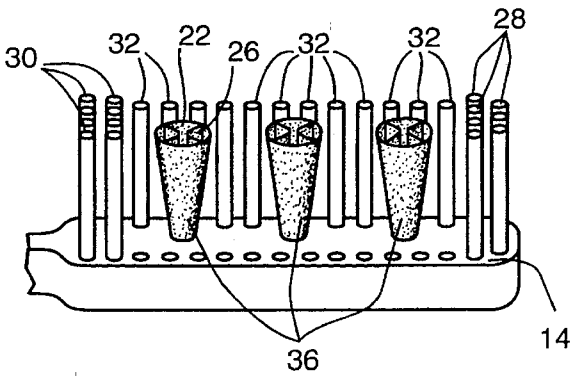
FIG. 5*a* is a partial cutaway perspective view of the prophy toothbrush of FIG. 4 illustrating substantially conical shaped prophy cup devices.
Figure 5:
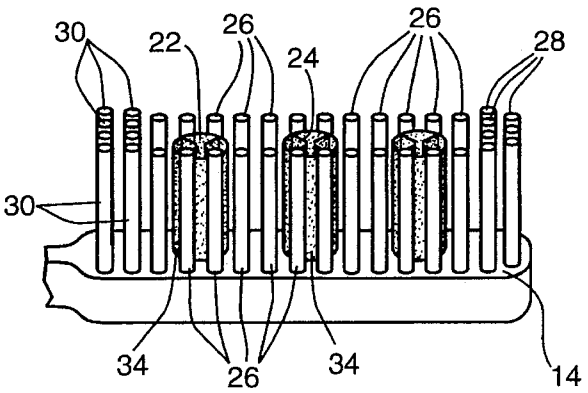
FIG. 5 is a partial cutaway perspective view of the prophy toothbrush of FIG. 4 illustrating the substantially cylindrical shaped prophy cup devices.

In the preferred embodiment, one prophy cup device 18 of a generally rectangular shape is employed. As shown in FIG. 1, the rectangular prophy cup device 18 is divided into a number of smaller rectangular sections 32, each of these section having a central cavity portion 22. However, the invention may be made with other configurations of prophy cup devices 18. For example, one or more prophy cup devices 18 may be used to provide the advantages of the prophy cup device 18, i.e., retaining tooth cleaning material and increasing the surface area contacting teeth. FIG. 4 and FIG. 5 illustrate the use of three substantially cylindrical shaped prophy cup devices 34 instead of a single substantially rectangular shaped prophy cup device. In the embodiment shown, the substantially cylindrical shaped prophy cup devices 34 also contain vanes 24 and central cavity portions 22. In alternative embodiments as shown in FIG. 5*a*, substantially conical shaped prophy devices 36 could be employed as well.

As shown in FIG. 1, also secured to the brush head 14 are a plurality of bristle tufts. The bristle tufts are placed around the perimeter of the sides 20 of the prophy cup device 18. Each bristle tuft is composed of a plurality of individual bristles (not shown). In the preferred embodiment these individual bristles are made of synthetic material, preferably nylon, and are approximately 0.005 to 0.006 inches in diameter. This bristle diameter allows the bristles to bend easily and causes the bristles to be gentle on the gums.

Figure 3:
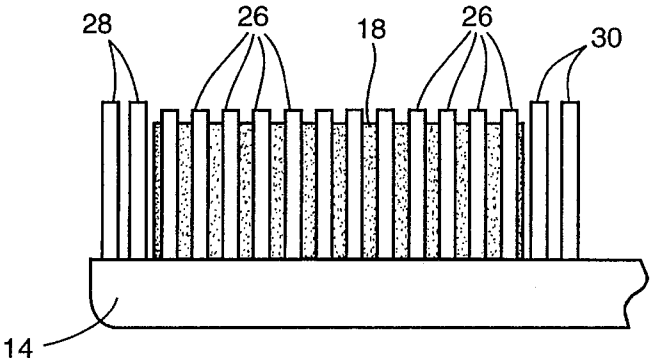
FIG. 3 is a side elevation view of the prophy toothbrush in accordance with the preferred embodiment, illustrating the positioning of a row of lateral bristle tufts relative to the leading bristle tufts and trailing bristle tufts, as well as the prophy cup device.

In the preferred embodiment, some bristle tufts are placed such that a row of lateral bristle tufts 26 is placed about and substantially symmetrically to sides of the prophy cup device 18, along lines substantially parallel to the longitudinal axis 16 of the handle 12. As shown in FIG. 3, these lateral bristle tufts 26 extend above the prophy cup device 18, the amount of extension being approximately 1.5 to 2 millimeters. Thus, the lateral bristle tufts 26 contact and scrub teeth during brushing before the prophy cup device 18 contacts the teeth.

Figure 2:
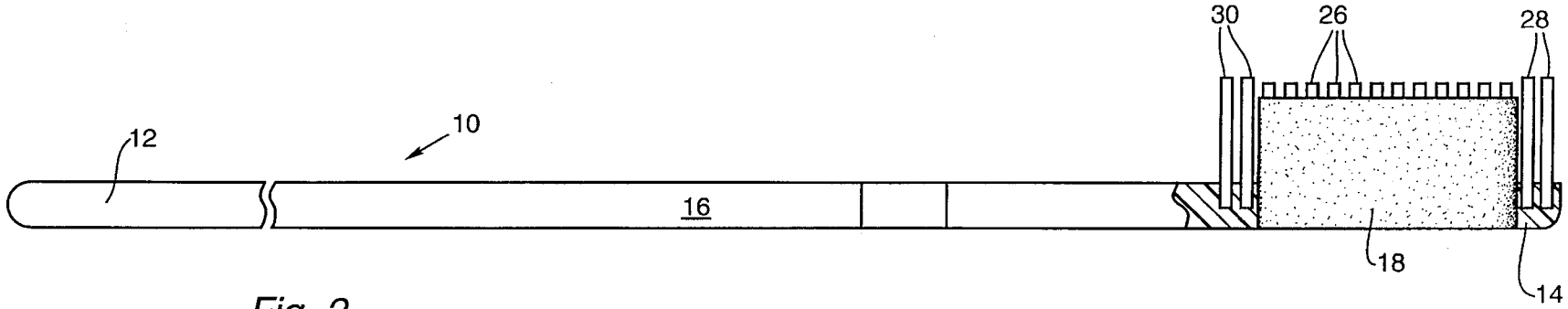
FIG. 2 is a partial cutaway side elevation view of the prophy toothbrush in accordance with the preferred embodiment, illustrating the positioning of a prophy cup device relative to a cluster of leading bristle tufts and a cluster of trailing bristle tufts.

Additional bristle tufts are placed on ends of the brush head 14 both most proximal to and most distal from the handle 12. Leading bristle tufts 28 are placed distal from the handle 12, and, as shown in FIG. 3, extend above the lateral bristle tufts 26. Trailing bristle tufts 30 placed proximal to the handle 12, also extend above the lateral bristle tufts 26. Of course, as shown in FIG. 2, both the leading bristle tufts 28 and trailing bristle tufts 30 extend above the prophy cup device 18.

To facilitate a greater understanding of the advantages of the illustrated preferred embodiment, operation of the toothbrush 10 is set forth as follows. To perform brushing, toothpaste or other tooth cleaning material is first placed so that it covers both the prophy cup device 18 and bristle tufts. Then, typically while holding the handle 12, the bristle tufts, lateral 26, leading 28, and trailing 30, are pressed against the teeth, and moved in a conventional toothbrushing manner. The bristle tufts scrub the surface of the teeth and between teeth. The leading bristle tufts 28 and trailing bristle tufts 30, being longer than the lateral bristle tufts 26, advance and follow between teeth, and are of special utility in cleaning the harder to reach posterior teeth. As the toothbrush 10 is pressed harder against the teeth, the prophy cup device 18 presses against the teeth, following the contour of the teeth, applying toothpaste to the teeth and thereby polishing the teeth. Thus, the combination of scrubbing and polishing the teeth provides a smoother, cleaner tooth surface than is provided by some other means. Additionally, the sides 20 of the prophy cup device 18 synergistically cooperate with the bristle tufts, tending to force the lateral bristle tufts 26 away from the prophy cup device 18 and towards and under the gum line, cleaning under the gum line.

Thus, an innovative prophy toothbrush, and a method for using the same have been disclosed. While variations of the illustrated preferred embodiment have been shown and described, it would be apparent to those skilled in the art that many more modifications are possible without departing from the inventive concepts herein. For example, instead of mounting the prophy cup device 18 and bristle tufts on a brush head 14 connected to a handle 12, the prophy cup device 18 and bristle tufts could be mounted to a platform (not shown) without a handle 12. Further, the bristle tufts could be placed in various arrangements on the platform or brush head 14. For example, instead of being placed about the prophy cup device 18, the bristle tufts could be placed on just one side of the prophy cup device 18. The invention, therefore, is not to be restricted except in the spirit of the appended claims.

I claim:

1. A toothbrush for brushing teeth and gums of human beings and animals, the toothbrush comprising:

(a) a long and narrow handle having a longitudinal axis;

(b) a brush head connected to the handle, the brush head having an end proximal to the handle and an end distal from the handle;

(c) a prophy cup device, made of a flexible elastomeric material, secured to the brush head, the prophy cup device comprising (1) sides extending from the brush head, (2) a central cavity portion allowing for placement of tooth cleaning material therein, and (3) a plurality of vanes extending from the sides of the prophy cup device into the central cavity portion;

(d) a plurality of lateral bristle tufts secured to the brush head, the lateral bristle tufts comprising a plurality of individual nylon bristles, the lateral bristle tufts extending above the prophy cup device and placed in at least one row on at least one of the sides of the prophy cup device along lines parallel to the longitudinal axis of the handle;

(e) a plurality of leading bristle tufts secured to the brush head, the leading bristle tufts comprising a plurality of individual nylon bristles, the leading bristle tufts extending above the lateral bristle tufts and placed on the end of the brush head distal from the handle; and (f) a plurality of trailing bristle tufts secured to the brush head, the trailing bristle tufts comprising a plurality of individual nylon bristles, the trailing bristle tufts extending above the lateral bristle tufts and placed on the end of the brush head proximal to the handle.

2. A toothbrush for cleaning teeth and below the gum line, the toothbrush comprising:

(a) a handle;

(b) a brush head connected to the handle;

(c) at least one prophy cup device secured to the brush head, the at least one prophy cup device comprising (1) sides extending from the brush head, and (2) at least one central cavity portion allowing for placement of tooth cleaning material therein; and (d) a plurality of bristle tufts secured to the brush head, the bristle tufts comprising a plurality of individual bristles, and being placed at least about a portion of the perimeter of the at least one prophy cup device for closely following and cleaning the surface of teeth and for cleaning under the gumline, and wherein the bristle tufts further comprise:

(1) a plurality of leading bristle tufts positioned distal from the handle;

(2) a plurality of trailing bristle tufts positioned proximal to the handle; and (3) a plurality of lateral bristle tufts positioned between the leading bristle tufts and the trailing bristle tufts, the leading bristle tufts and trailing bristle tufts being longer than the lateral bristle tufts for effective cleaning of teeth which are difficult to reach with the toothbrush.

* * * * *